US007855892B2

(12) United States Patent
Lin

(10) Patent No.: US 7,855,892 B2
(45) Date of Patent: Dec. 21, 2010

(54) PROTECTIVE JACKET OF ELECTRICAL DEVICE

(75) Inventor: Chin-Sheng Lin, Taipei (TW)

(73) Assignee: Fruitshop International Corporation, Taipei (TW)

( * ) Notice: Subject to any disclaimer, the term of this patent is extended or adjusted under 35 U.S.C. 154(b) by 481 days.

(21) Appl. No.: 11/964,252

(22) Filed: Dec. 26, 2007

(65) Prior Publication Data

US 2008/0198562 A1 Aug. 21, 2008

(30) Foreign Application Priority Data

Feb. 16, 2007 (TW) ..... 96203194 U

(51) Int. Cl.
*H05K 5/03* (2006.01)

(52) U.S. Cl. ..... 361/730; 361/737; 361/679.36; 206/701; 439/131

(58) Field of Classification Search ..... 361/728, 361/730, 737, 752, 679.34, 679.36; 174/520; 439/131; 206/701
See application file for complete search history.

(56) References Cited

U.S. PATENT DOCUMENTS 7,416,424 B1 * 8/2008 Deckman ..... 439/135
2006/0082963 A1 * 4/2006 Chen ..... 361/684

* cited by examiner

*Primary Examiner*—Dameon E Levi
(74) *Attorney, Agent, or Firm*—Chun-Ming Shih; HDLS IPR Services

(57) ABSTRACT

A protective jacket for covering an electrical device is provided. The protective jacket includes a first shell and a second shell. The first shell includes a front cover, a rear cover, and an elastic strip. The front and the rear covers are formed apart from each other and have an individual hollow for receiving the insertion of the device. The elastic strip is formed between these covers. A space is defined on the first shell by theses covers, and the elastic strip together. The second shell is configured to be disposed within the space of the first shell, and has a slot for receiving the insertion of the device. Therefore, the protective jacket conforms to the shape of the device and is capable of covering the device compactly for preventing damages due to collision and avoiding dust and mist pollution so as to increase the life of the device substantially.

9 Claims, 7 Drawing Sheets

PROTECTIVE JACKET OF ELECTRICAL DEVICE

BACKGROUND OF THE INVENTION

1. Field of the Invention

The present invention is related to a protective jacket, and more particular to a protective jacket for covering an electrical device, such as a USB portable storage device.

2. Description of Related Art

Technology advances bring a variety of commercial electrical devices, such as USB portable storage devices (USB flash discs), cell phones, and MP3 players. These technologies have not only enriched our lives but also improved our work efficiency. Among the foregoing electrical devices, USB portable storage devices are used to store data popularly because of the advantages of huge storage capacity, fast transmission rate, low cost, convenience, and pluggable feature. However, users usually lost their USB portable storage devices carelessly due to the small size. Beside, the USB connector of the device is easily damaged by collision. For overcoming the foregoing problems, suppliers provide an USB portable device with a protective jacket.

Please refer to FIG. 1A and FIG. 1B illustrating top views showing a protective jacket of an electrical device according to a prior art. As shown in FIG. 1A and FIG. 1B, the protective jacket includes a shell 65 and a fastening structure 68. The shell 65 includes a chamber 650 for receiving the insertion of the electrical device 60, and an opening 652 interlinked to the chamber 650 for leaving the connector 600 of the electrical device 60 revealed outside the shell 65. One end of the fastening structure 68 is connected to the electrical device 60, and the other end of the fastening structure 68 is left outside the shell 65. By actuating the exterior end of the fastening structure 68, the connector 600 would be extended outside the shell 65 or embedded inside the shell 65.

Although the protective jacket of the prior art protects the connector of the electrical device, there still are several problems illustrated as follows. The electrical device has a specific shape, and the fastening structure thereof has to conform to the shape of the electrical device for attachment. In order to provide protective jackets matching electrical devices with different shapes, suppliers have to spend high cost to set many molds for fabricating parts in different shapes. Besides, dust and mist will easily diffuse into the electrical device through the opening arranged on the shell and damage the device. Thus the life of the electrical device will be decreased. Therefore, the inventor offers the present invention for overcoming the problems set above.

SUMMARY OF THE INVENTION

Accordingly, the objective of the present invention is to provide a protective jacket for covering an electrical device that prevents damages due to collision and avoids dust and mist pollution so as to increase the life of the electrical device substantially by assembling a first shell, a matching second shell, and the electrical device together to cover the electrical device compactly.

In order to achieve the foregoing objective, the present invention provides a protective jacket for covering an electrical device. The protective jacket includes a first shell and a second shell. The first shell includes a rear cover, a front cover, and an elastic strip. The front cover is formed apart from the rear cover correspondingly. The front cover and the rear cover both have an individual hollow formed therein for receiving the insertion of the electrical device. The elastic strip is formed between the rear cover and the front cover. A space is defined on the first shell by the rear cover, the front cover, and the elastic strip together. The second shell is configured to be disposed within the space of the first shell. The second shell has a slot formed therein for receiving the insertion of the electrical device.

The objective of the present invention will no doubt become obvious to those of ordinary skill in the art after reading the following detailed description of the preferred embodiment, which is illustrated in the various figures and drawings.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

The objective of the present invention will no doubt become obvious to those of ordinary skill in the art after reading the following detailed description of the preferred embodiment, which is illustrated in the various figures and drawings.

Figure 1A:
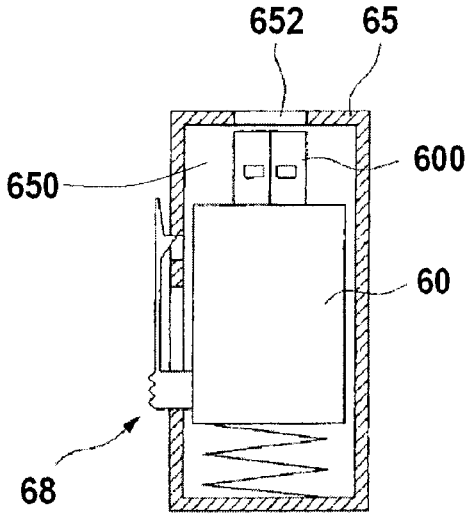
FIG.1A (Prior Art)
FIG. 1A and FIG. 1B are top views showing a protective jacket of an electrical device according to a prior art.
Figure 1B:
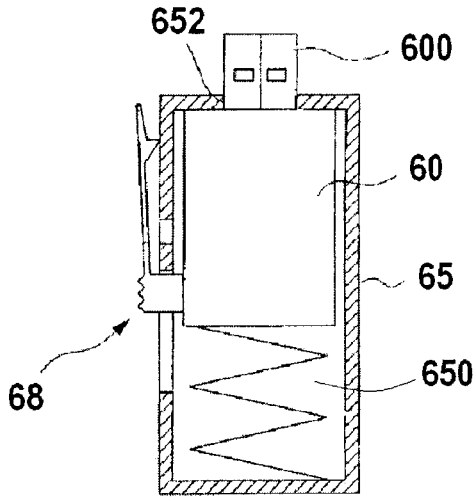
FIG.1B (Prior Art)
Figure 2:
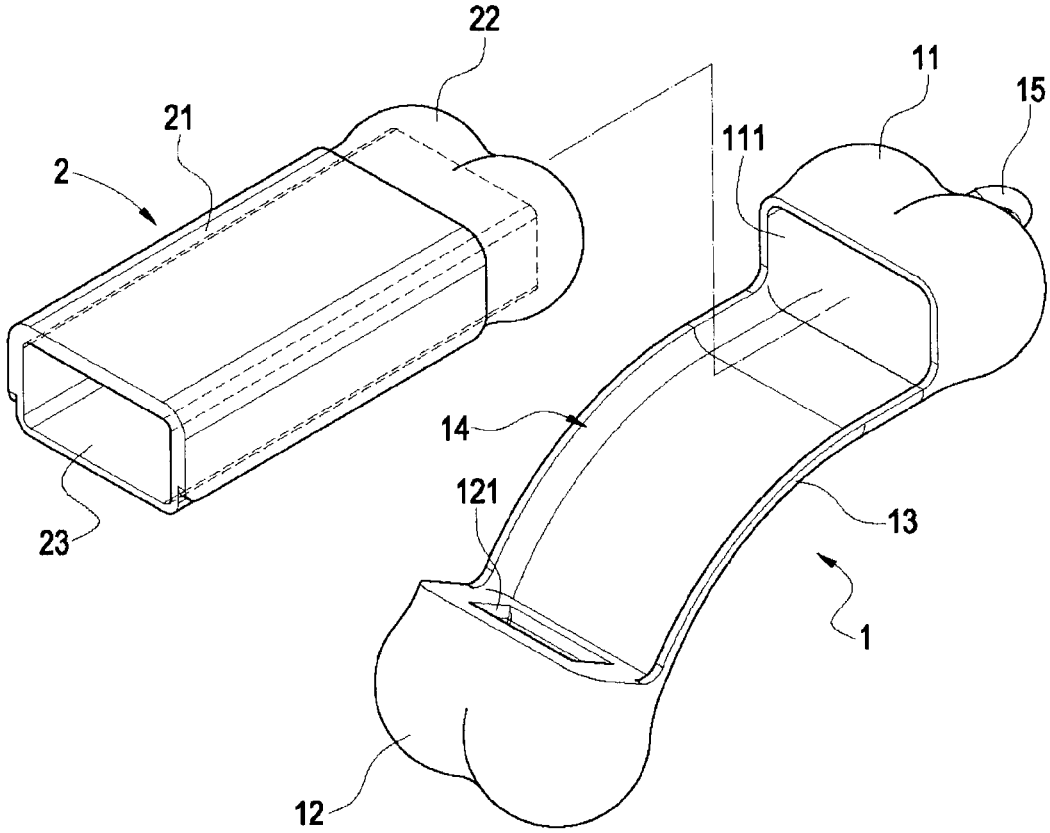
FIG. 2 is an exploded elevational view showing a protective jacket according to the first embodiment of the present invention.
Figure 3:
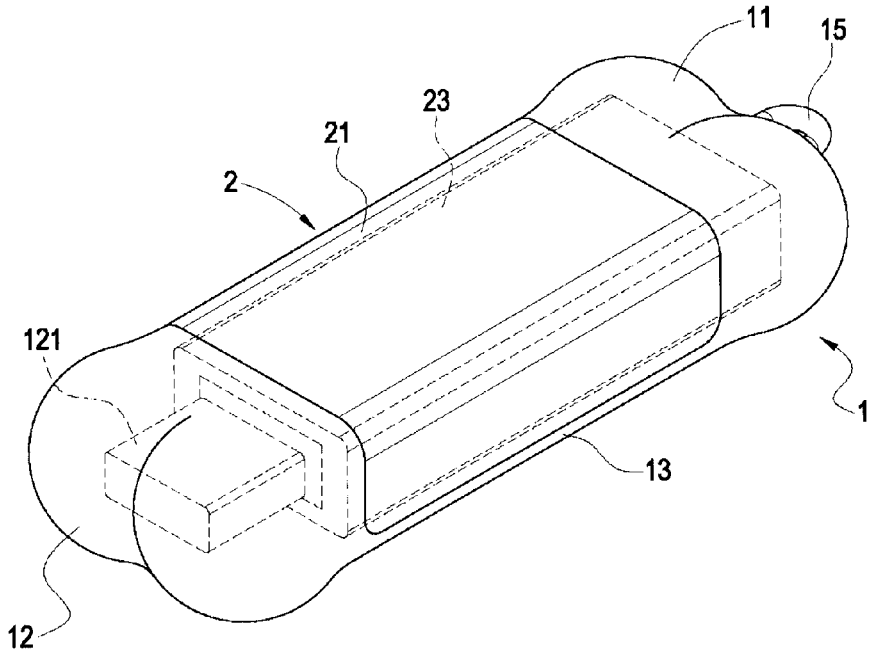
FIG. 3 is an assembly view thereof.

The present invention provides a protective jacket for covering an electrical device. Please refer to FIG. 2, FIG. 3, and FIG. 4 respectively illustrating an exploded elevational view, an assembly view, and a sectional assembly view of a protective jacket according to the first embodiment of the present invention. The protective jacket includes a first shell 1 and a second shell 2. The first shell 1 and the second shell 2 are matched and conform to the shape of the electrical device.

The first shell 1 could be made of elastic materials, such as silica gel, rubber, or etc. The first shell 1 includes a rear cover 11 and a front cover 12 formed apart from the rear cover 11 correspondingly. The rear cover 11 and the front cover 12 are both worked into the shape of half-heart and include hollows 111, 121 respectively formed therein. The first shell 1 further includes an elastic strip 13 formed between the rear cover 11 and the front cover 12. A space 14 is defined on the first shell 1 by the rear cover 11, the front cover 12, and the elastic strip 13 together. In addition, the first shell 11 includes a bail 15 formed on the exterior surface of the rear cover 11 for receiving a string passing through.

Figure 4:
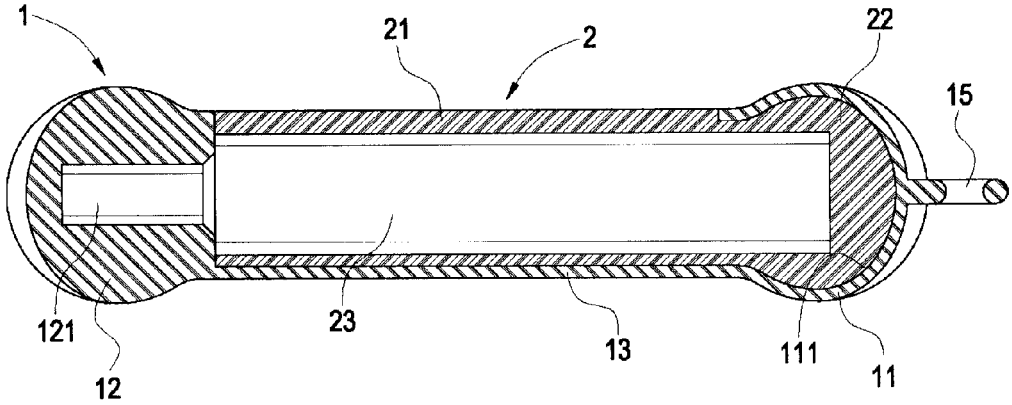
FIG. 4 is a sectional assembly view thereof.

The second shell 2 could be made of elastic materials, such as silica gel, and rubber, or etc. The second shell 2 includes a rectangular sleeve 21, and a bag 22 connected to one end of the rectangular sleeve 21. The bag 22 is also worked into the shape of half-heart. The interior of the bag 22 and the rectangular sleeve 21 are interlinked so as to define a slot 23 together. The rectangular sleeve 21 is configured to be disposed within the space 14. As shown in FIG. 4, the front end and the rear end of the rectangular sleeve 21 are respectively attached to the corresponding surfaces of the rear cover 11 and the front cover 12, and the bag 22 is exactly disposed within the hollow 111 of the rear cover 11.

Figure 5:
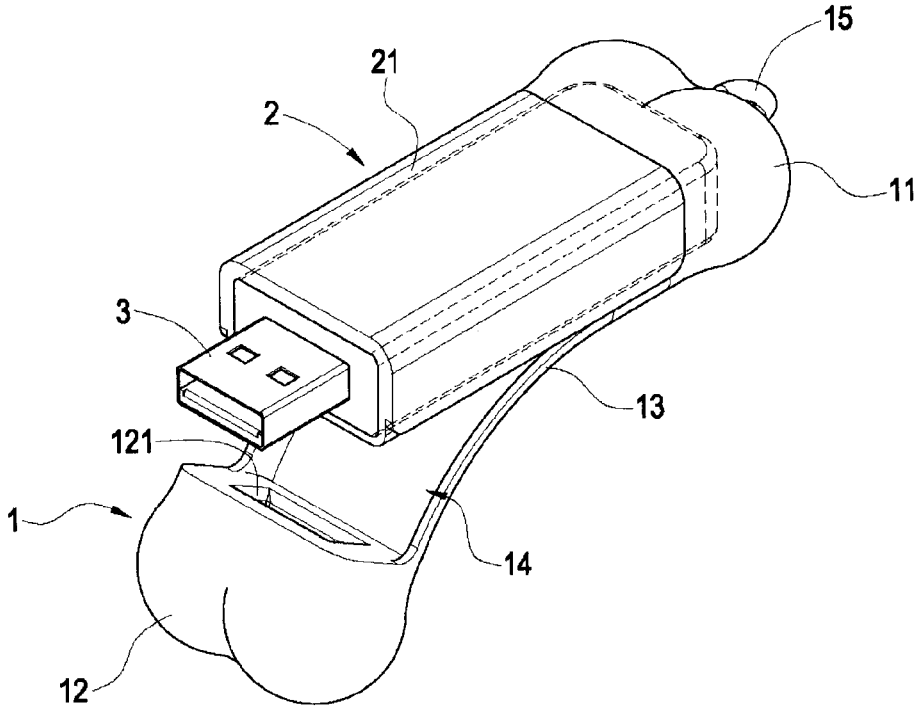
FIG. 5 is an assembly view showing that the protective jacket according to the present invention is applied to cover an electrical device.
Figure 6:
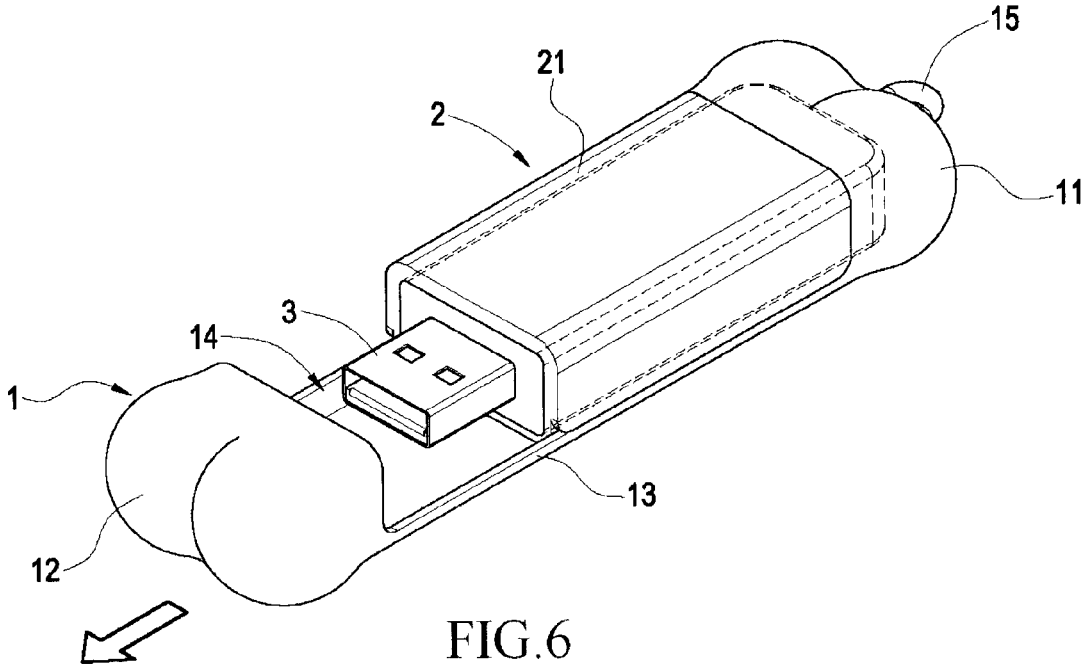
FIG. 6 is an elevational view associated with FIG. 4 showing that the front cover is elongated.

Please refer to FIG. 5 and FIG. 6 respectively illustrating an assembly view showing that the protective jacket according to the present invention is applied to cover an electrical device, and an elevational view associated with FIG. 5 showing that the front cover is elongated. The presented protective jacket is capable of covering an electrical device 3, such as a USB portable storage device. As shown in FIG. 5, the assembly process of the protective jacket and the electrical device 3 firstly is to place one end of the electrical device 3 into the bag 22 by passing through the slot 23 of the second shell 2. The next step is to place the bag 22 of the second shell 2 into the hollow 111 of the rear cover 11. Afterward, as shown in FIG. 6, the next step is to remove the front cover 12 to depart from the rear cover 11 and the elastic strip 13 is elongated. The last step for assembling the protective jacket and the electrical device 3 is to place the other end of the electrical device 3 into the front cover 12 and make the interior surface of the front cover 12 to attach to the corresponding side of the second shell 2 compactly.

Figure 7:
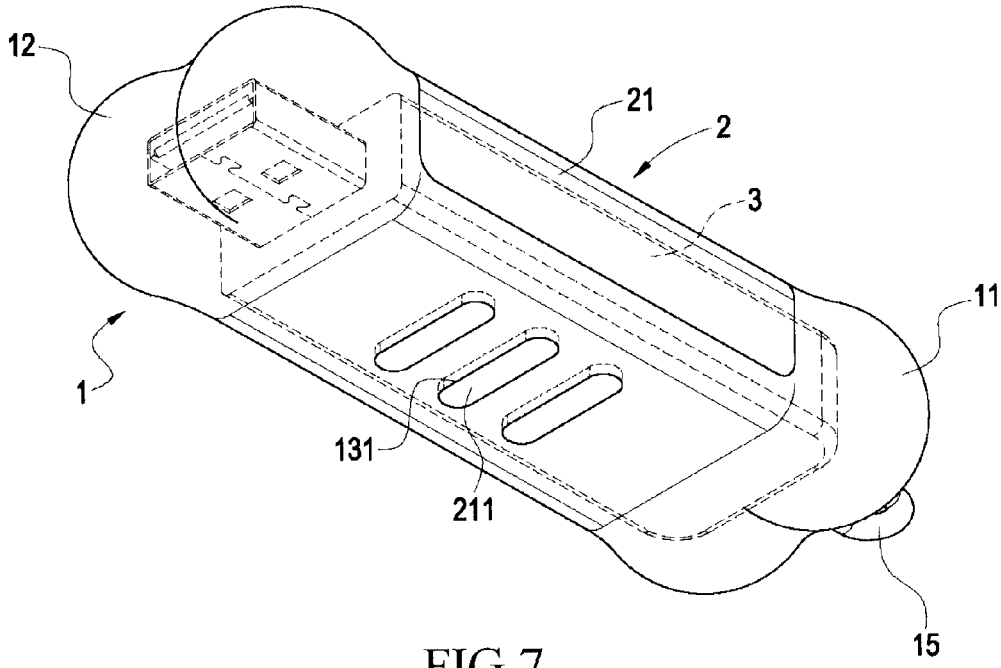
FIG. 7 is an assembly view showing that a protective jacket according to the second embodiment of the present invention is assembled with an electrical device.
Figure 8:
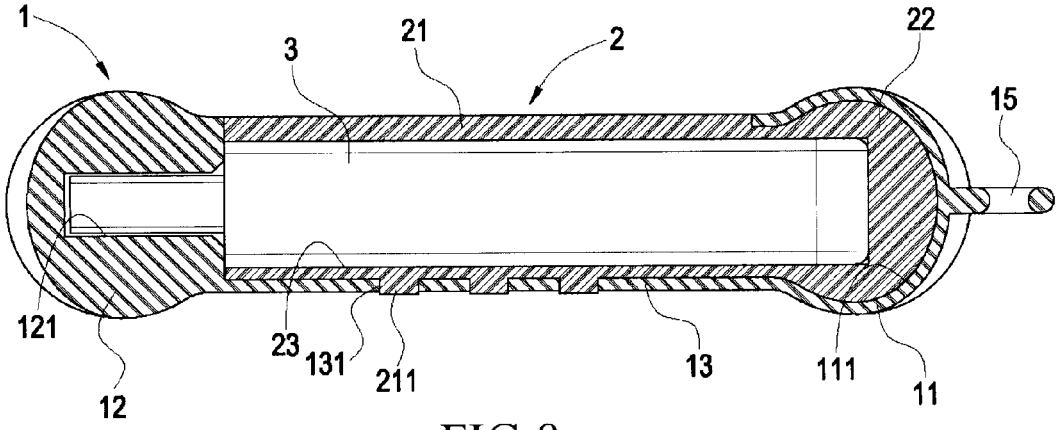
FIG. 8 is a sectional assembly view thereof.

Please refer to FIG. 7 and FIG. 8 respectively illustrating an assembly view showing that a protective jacket according to the second embodiment of the present invention is assembled with an electrical device, and a sectional assembly view thereof. According to the second embodiment, the first shell 1 further includes a plurality of bar openings 131 formed on the elastic strip 13 in parallel so as to increase the elongation capacity of the elastic strip 13. Furthermore, the second shell 2 includes a plurality of bosses 211 arranged on the rear side thereof correspondingly to the openings 131 for fastening the first shell 1 the second shell 2 to attach to each other closely.

Figure 9:
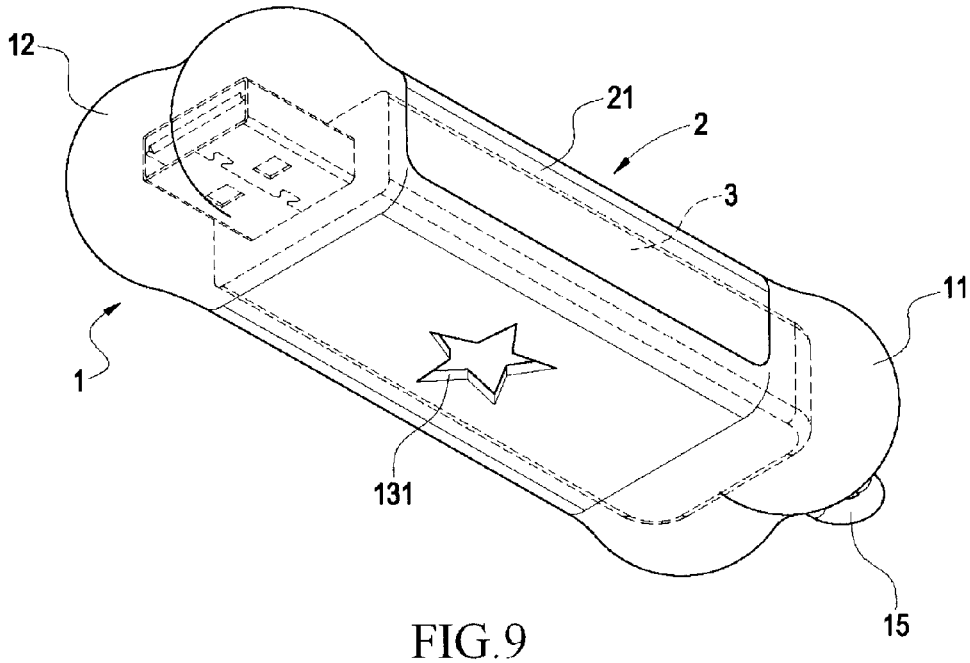
FIG. 9 is an assembly view showing that a protective jacket according to the third embodiment of the present invention is assembled with an electrical device.
Figure 10:
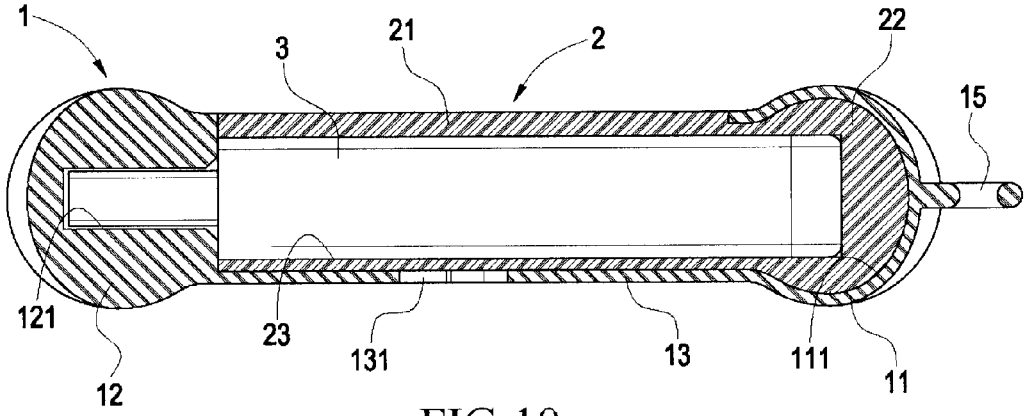
FIG. 10 is a sectional assembly view thereof.

Please refer to FIG. 9 and FIG. 10 respectively illustrating an assembly view showing that a protective jacket according to the third embodiment of the present invention is assembled with an electrical device, and a sectional assembly view thereof. According to the embodiment, the first shell 1 includes a star opening 131 formed on the elastic strip 13. Moreover, the first shell 1 and the second shell 2 could be made in different colors. Thus, the star opening 131 arranged on the elastic strip 13 of the first shell 1 not only increases the elongation capacity, but also decorates and beautifies the protective jacket.

Figure 11:
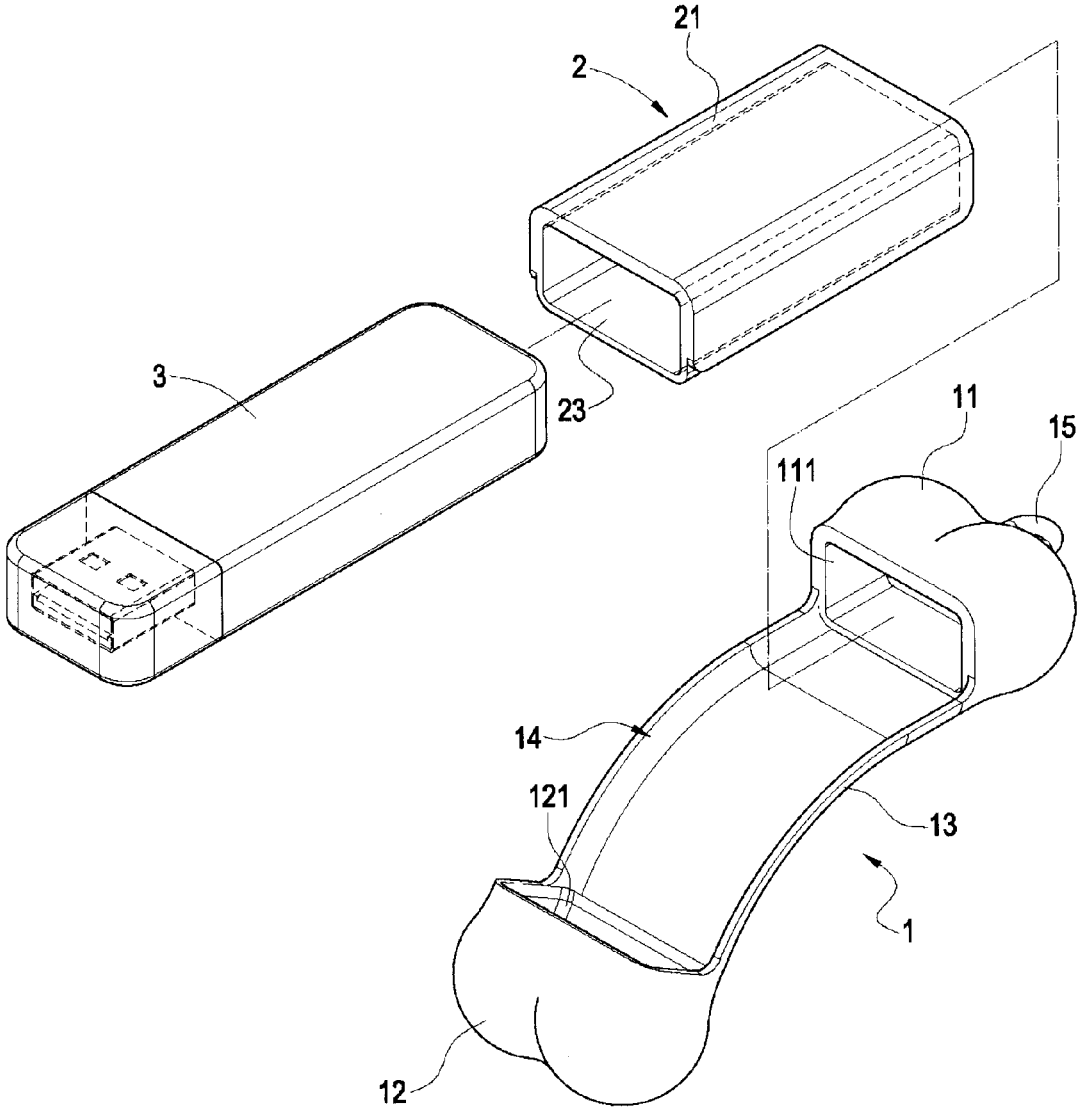
FIG. 11 is an exploded elevational view showing that a protective jacket according to the fourth embodiment of the present invention is assembled with an electrical device.

Please refer to FIG. 11 illustrating an exploded elevational view showing that a protective jacket according to the fourth embodiment of the present invention is assembled with an electrical device. For matching with an electrical device 3 having an individual shell, the second shell 2 only includes a rectangular sleeve 21 with a slot 23 formed therein for receiving the insertion of the electrical device 3. The assembly process of the protective jacket and the electrical device 3 firstly is to install the electrical device 3 in the slot 23, and leave the front end and the rear end revealed outside the second shell 2. The next assembly step is to place the front end and the rear end of the electrical device 3 within the hollows 111, 121 of the first shell respectively. Thus the protective jacket is assembled with the electrical device 3 quickly.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A protective jacket for covering an electrical device, comprising: a first shell, comprising: a rear cover, having a hollow formed therein for receiving the insertion of the electrical device; a front cover, correspondingly formed apart from the rear cover, the front cover having a hollow formed therein for receiving the insertion of the electrical device; and an elastic strip, formed between the front cover and the rear cover, wherein a space is defined on the first shell by the front cover, the rear cover, and the elastic strip together; and a second shell, configured to be disposed within the space of the first shell, the second shell having a slot formed therein for receiving the insertion of the electrical device, wherein the second shell further comprises a sleeve and the slot is formed in the sleeve, and wherein the second shell further comprises a bag connected to one end of the sleeve, the interior of the bag and the sleeve are interlinked, and the bag is configured to be disposed within the hollow of the rear cover.

2. The protective jacket according to claim 1, wherein the first shell consists of silica gel.

3. The protective jacket according to claim 1, wherein the first shell consists of rubber.

4. The protective jacket according to claim 1, wherein the first shell further comprises a bail formed on the exterior surface of the rear cover.

5. The protective jacket according to claim 1, wherein the second shell consists of silica gel.

6. The protective jacket according to claim 1, wherein the second shell consists of rubber.

7. A protective jacket for covering an electrical device, comprising: a first shell, comprising: a rear cover, having a hollow formed therein for receiving the insertion of the electrical device; a front cover, correspondingly formed apart from the rear cover, the front cover having a hollow formed therein for receiving the insertion of the electrical device; and an elastic strip, formed between the front cover and the rear cover, wherein a space is defined on the first shell by the front cover, the rear cover, and the elastic strip together; and a second shell, configured to be disposed within the space of the first shell, the second shell having a slot formed therein for receiving the insertion of the electrical device, wherein the first shell further comprises at least one opening formed on the elastic strip, and the second shell further comprises at least one boss arranged thereon correspondingly to the at least one opening.

8. A protective jacket for covering an electrical device, comprising: a first shell, comprising: a rear cover, having a hollow formed therein for receiving the insertion of the electrical device; a front cover, correspondingly formed apart from the rear cover, the front cover having a hollow formed therein for receiving the insertion of the electrical device; and an elastic strip, formed between the front cover and the rear cover, wherein a space is defined on the first shell by the front cover, the rear cover, and the elastic strip together; and a second shell, configured to be disposed within the space of the first shell, the second shell having a slot formed therein for receiving the insertion of the electrical device, wherein the first shell further comprises a plurality of openings formed on the elastic strip in parallel, and the second shell further comprises a plurality of bosses arranged thereon correspondingly to the openings.

9. The protective jacket according to claim 1, wherein the first shell further comprises at least one opening formed on the elastic strip.

* * * * *